US005228510A

United States Patent [19]

Jennings, Jr. et al.

[11] Patent Number: 5,228,510

[45] Date of Patent: Jul. 20, 1993

[54] METHOD FOR ENHANCEMENT OF SEQUENTIAL HYDRAULIC FRACTURING USING CONTROL PULSE FRACTURING

[75] Inventors: Alfred R. Jennings, Jr., Plano; Malcolm K. Strubhar, Irving, both of Tex.

[73] Assignee: Mobil Oil Corporation, Fairfax, Va.

[21] Appl. No.: 885,790

[22] Filed: May 20, 1992

[51] Int. Cl.[5] ..... E21B 33/138; E21B 43/263; E21B 43/267

[52] U.S. Cl. ..... 166/263; 166/271; 166/281; 166/299; 166/308

[58] Field of Search ..... 166/263, 271, 281, 299, 166/308

[56] References Cited

U.S. PATENT DOCUMENTS

| | | | |
|---|---|---|---|
| 3,613,785 | 10/1971 | Closmann et al. | 166/271 |
| 3,682,246 | 8/1972 | Closmann | 166/271 |
| 4,067,389 | 1/1978 | Savins | 166/246 |
| 4,109,721 | 8/1978 | Slusser | 166/280 |
| 4,333,461 | 6/1982 | Muller . | |
| 4,548,252 | 10/1985 | Stowe et al. | 166/299 |
| 4,718,490 | 1/1988 | Uhri | 166/281 |
| 4,724,905 | 2/1988 | Uhri | 166/263 X |
| 4,834,181 | 5/1989 | Uhri et al. | 166/281 |

*Primary Examiner*—George A. Suchfield

*Attorney, Agent, or Firm*—A. J. McKillop; G. W. Hager; C. A. Malone

[57] ABSTRACT

A method for fracturing a subterranean formation containing desired natural resources in which controlled pulse fracturing (CPF) is combined with hydraulic fracturing in a second wellbore along with hydraulic fracturing in a first wellbore. Multiple radial vertical fractures are created by CPF in the second wellbore by a solidifiable gel material which is directed into created fractures during a subsequent hydraulic fracturing procedure. During this procedure, multiple vertical hydraulic fractures initiate in and propagate away from CPF created fractures thereby bringing the second wellbore fracture system into fluid communication with the fracture system of the first wellbore.

8 Claims, 1 Drawing Sheet

METHOD FOR ENHANCEMENT OF SEQUENTIAL HYDRAULIC FRACTURING USING CONTROL PULSE FRACTURING

FIELD OF THE INVENTION

This invention relates to a method for extending multiple radial fractures obtained during controlled pulse fracturing (CPF) of an underground formation in one wellbore so as to intersect a hydraulic fracture created in another wellbore. A blocking agent and hydraulic fracturing are utilized to extend said multiple radial hydraulic fractures.

BACKGROUND OF THE INVENTION

It has been known for some time that the yield of hydrocarbons, such as gas and petroleum, from wells can be increased by fracturing the formation so as to stimulate the flow of hydrocarbons into the well. Various formation fracturing procedures have been proposed and many now are in use. Among these procedures are treatments with various chemicals (usually acids in aqueous solutions), hydraulic fracturing in which liquids are injected under high pressure (usually with propping agents), explosive methods in which explosives are detonated within a formation to effect mechanical fracture, and combinations of the above procedures.

A combustion method designed to stimulate a well through mechanical fracturing is known as controlled pulse fracturing (CPF) or high energy gas fracturing. A good description of this method appears in an article by Cuderman, J. F., entitled "High Energy Gas Fracturing Development," Sandia National Laboratories, SAND 83-2137, October 1983. Using this method enables the multiple fracturing of a formation or reservoir in a radial manner which increases the possibility of contacting natural fractures. Unfortunately, these radial fractures often do not penetrate deeply enough into the formation.

A hydraulic fracturing method designed to control fracture trajectories in a formation penetrated by two closely-spaced wells is known as sequential hydraulic fracturing. In sequential hydraulic fracturing, the direction that a hydraulic fracture will propagate is controlled by altering the local in-situ stress distribution in the vicinity of the first wellbore. By this method, a hydraulic fracturing operation is conducted at the first wellbore wherein a hydraulic pressure is applied to the formation sufficient to cause a hydraulic fracture to form perpendicular to the least principal in-situ stress. While maintaining pressure in this first hydraulic fracture, a second hydraulic fracture is initiated in the second wellbore. This second hydraulic fracture, due to the alteration of the local in-situ stresses by the first hydraulic fracture will initiate at an angle, possibly perpendicular, to the first hydraulic fracture. In propagating, this second hydraulic fracture then has the potential of intersecting natural fractures not contacted by the first hydraulic fracture, thereby significantly improving the potential for enhanced hydrocarbon production and cumulative recovery.

Uhri teaches a method for the creation of multiple hydraulic fractures where hydraulic fracturing is combined with control pulse fracturing in a single wellbore. This teaching is disclosed in U.S. Pat. No. 4,718,490 which issued on Jan. 12, 1988. This patent is hereby incorporated by reference herein. Although effective, this method does not provide the flexibility needed for removing hydrocarbonaceous fluids from the reservoir where the producing areas are established by state or federal governmental regulations.

Therefore, what is needed is a method which combines both CPF and hydraulic fracturing techniques in one well while delineating a producing area by use of another well which is used to fracture the producing area so as to permit substantially improved drainage of hydrocarbonaceous fluids or other resources from said area.

SUMMARY OF THE INVENTION

This invention is directed to a method for creating and extending multiple vertical radial hydraulic fractures via hydraulic fracturing which is combined with control pulse fracturing where two wells are utilized. Initially, a first and second well are drilled and completed in a formation or reservoir so that said wells will be in fluid communication with each other after subsequent fracturing in each well. Thereafter, multiple vertical radial fractures are created in a subterranean formation by energy resultant from a CPF method conducted in the second well. These multiple radial fractures are short in length.

Next, a hydraulic fracturing operation is conducted in the first well which results in a hydraulic fracture being formed in the reservoir. This fracture is at a distance sufficient to permit fluid communication subsequently between the wells.

Following the hydraulic fracturing in the first well, hydraulic pressure is applied to said second wellbore in an amount sufficient to fracture the formation while the first well is shut in without artificial pressure thereon. Upon commencement of the hydraulic fracturing treatment, a first hydraulic fracture is initiated in the second well from the CPF created radial fracture which is closest to being substantially perpendicular to the least principal in-situ stress.

While maintaining the hydraulic pressure on the formation via said second well and propagating this first hydraulic fracture, alternating slugs of a thin-fluid spacer and gelled proppant slurry, or quick-setting blocking polymer, with or without proppant, are pumped into this fracture. After penetrating into the formation for a substantial distance, this first instituted hydraulic fracture "screens out", thereby preventing additional fluid from entering the fracture.

The pumping rate and hydraulic pressure are maintained and not allowed to drop thereby causing a second hydraulic fracture to be initiated. The second hydraulic fracture initiates from the tip of another radial fracture. The specific radial fracture from which a hydraulic fracture will be initiated is that fracture which has the least closure stress resulting from the interaction of the first hydraulic fracture and the original in-situ stress. The second hydraulic fracture has a trajectory which curves away from the first hydraulic fracture and is subsequently propagated perpendicular to the least principal in-situ stress. As was done with the first hydraulic fracture, the second hydraulic fracture is propagated while pumping alternating slugs of spacer fluid and a temporary blocking agent with proppant therein.

Once the second fracture screens out, a third hydraulic fracture originates from the tip of the next radial fracture which has the least closure stress resulting from the interaction of said first and second hydraulic fractures and the original in-situ stress. Hydraulic fracturing pressure and the pumping rate are maintained as above mentioned and another curved fracture is propagated. As the propagated curved fractures continue through the formation, they intersect the hydraulic fracture created by the first wellbore. Because the propagated curved fractures intersect with the hydraulic fracture from the first wellbore, fluid communication is therefore established between these hydraulic fractures. Fluid communication established in this manner thus allows the formation to be drained of desired resources. Creation of curve fractures as above mentioned are continued until such time as a sufficient number are induced into the formation. Thereafter, increased volumes of desired natural resources are produced from the formation, particularly hydrocarbonaceous fluids.

It is therefore an object of this invention to create more than two simultaneous multiple radial vertical fractures near a second wellbore in a formation so as to communicate fluidly with a fracture in a first wellbore.

It is another object of this invention to avoid damaging the rock near said second wellbore when creating multiple radial vertical fractures.

It is yet another further object of this invention to cause multiple hydraulic fractures in a second wellbore to communicate fluidly with an induced fracture system in a first wellbore.

It is yet another further object of this invention to obtain increased quantities of natural resources from a formation, particularly hydrocarbonaceous fluids.

It is a still further object of this invention to locally alter in-situ stress conditions and produce multiple vertical propped permeable sequential hydraulic fractures which curve away from a second wellbore toward a fracture system in a first wellbore.

It is still yet another object of this invention to extend multiple vertical radial fractures resultant from controlled pulse fracturing (CPF) by application of hydraulic fracturing in combination with a temporary blocking agent so as to communicate these fractures with another induced fracture system.

BRIEF DESCRIPTION OF THE DRAWINGS

FIG. 2 is a schematic representation showing the fractures resultant from the fracturing operations which are communicating from the second well into the first well which has been shut-in.

DESCRIPTION OF THE PREFERRED EMBODIMENTS

Figure 1:
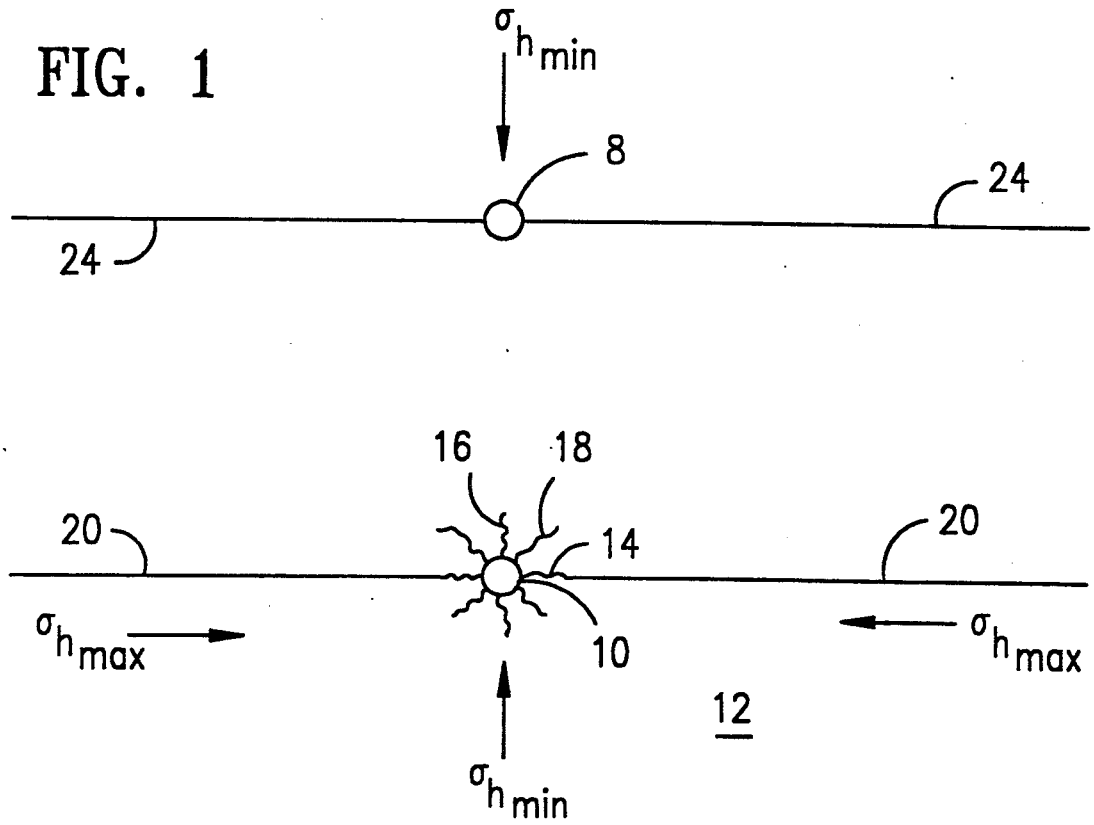
FIG. 1 is a schematic representation of a first well which has been hydraulically fractured and a second well in which a controlled pulse fracturing operation has been conduced therein.

In the practice of this invention, referring to FIG. 1, a first well 8 is hydraulically fractured so as to create hydraulic fractures 24 in the formation. A hydraulic fracturing technique which can be used in the practice of this invention is disclosed by Savins in U.S. Pat. No. 4,067,389 which issued on Jan. 10, 1978. This patent is hereby incorporated by reference herein. After first well 8 has been hydraulically fractured, it is shut-in and a control pulse fracturing operation (CPF) is conducted in the second well. This CPF method produces more than two simultaneous multiple vertical fractures 14, 16 and 18 from wellbore 10 in formation 12. The order of the fracturing operations in the wells is not essential to the practice of this invention.

Once the CPF treatment has been completed, hydraulic fracturing is initiated by injecting alternating slugs of a thin-fluid spacer and a temporary blocking agent containing proppant into wellbore 10. This temporary blocking agent is either a viscous hydraulic fracturing gel or a quick-setting temporary blocking polymer, both of which are well-known to those skilled in the art of hydraulic fracturing. When the injection fluid treating pressure applied to wellbore 10 is sufficient to fracture formation 12, a first hydraulic fracture 20 is initiated from the CPF created radial vertical fracture 14 which is closest to being substantially perpendicular to the least principal horizontal in-situ stress "$\sigma_h$, min" as indicated in the drawing. The maximum principal horizontal in-situ stress is designated in the drawing as "$\sigma_h$, max". Each of these principal horizontal 1 in-situ stresses is considered to be less then the vertical in-situ stress.

While maintaining pressure in the first hydraulic fracture 20 and propagating this fracture into formation 12, alternating slugs of a thin-fluid spacer and a temporary blocking agent containing a proppant therein are injected into this fracture via the second wellbore 10. As this first hydraulic fracture 14 propagates, the thin-fluid spacer leaks off into the permeable formation 12, leaving behind the temporary blocking agent containing said proppant so as to eventually form a propped fracture 14 that cannot accept any more fluids. Proppants and methods for packing said proppants are discussed in U.S. Pat. No. 4,109,721 that issued to Slusser on Aug. 29, 1978. This patent is hereby incorporated by reference herein. Said proppant should be of a size sufficient to prop any resultant fractures, and be about 8 to about 60 U.S. mesh size. Sand of about this mesh size can be used. The injected fluid is then automatically diverted due to this "screen out" phenomenon to another CPF created radial vertical fracture 18. The thin-fluid spacer can comprise water, diesel oils, alcohols, high gravity crude oils, petroleum distillates, aqueous acid solutions, and mixtures thereof.

Figure 2:
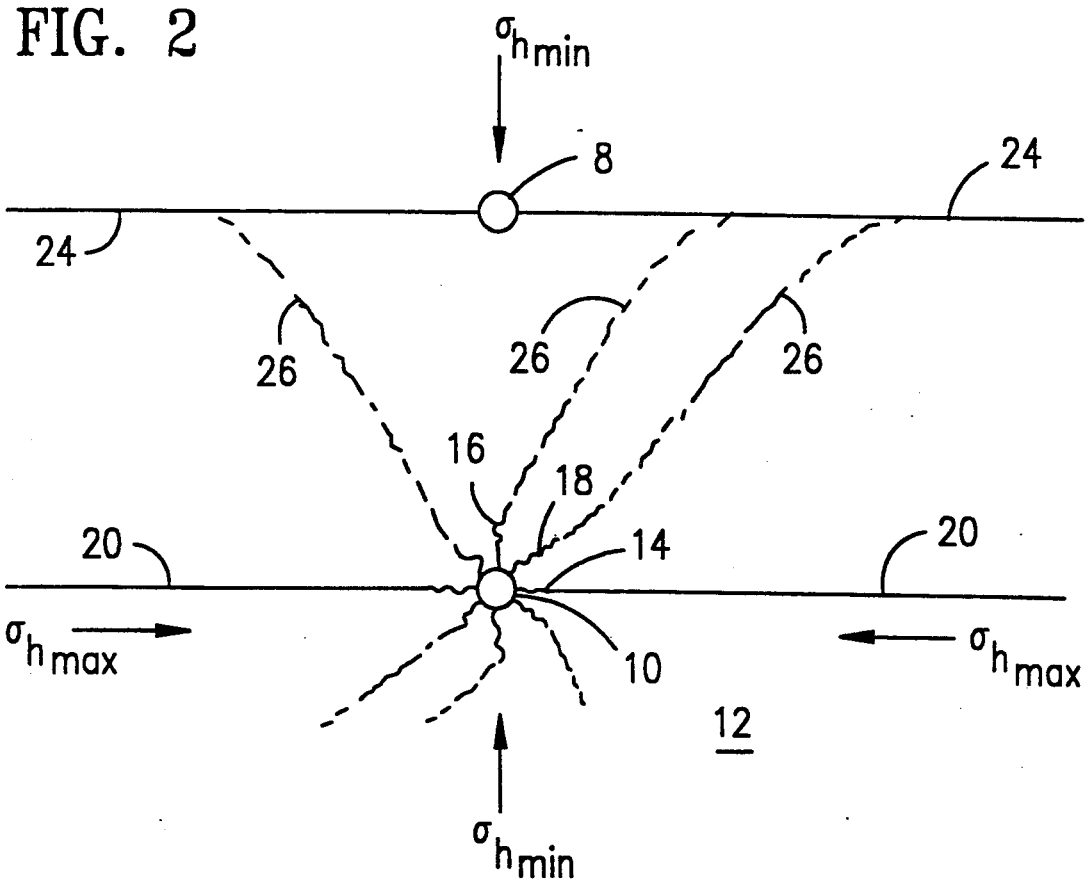

The pumping rate and hydraulic pressure are maintained in wellbore 10 and not allowed to drop thereby causing a second hydraulic fracture 26 to initiate from CPF created radial vertical fracture 18. This is shown in FIG. 2. Second hydraulic fracture 26 emanates from the tip of CPF fracture 18 since CPF fracture 18 now exhibits the least closure stress due to the interaction of blocked first hydraulic fracture 14 and the original in-situ stresses. This second hydraulic fracture 26 has a trajectory which curves away from the first hydraulic fracture 20 and is subsequently propagated perpendicular to the least principal in-situ stress "$\sigma_h$, min". after intersecting induced hydraulic fracture 24 which emanates from first wellbore 8.

As was done with the first hydraulic fracture 20, the second hydraulic fracture 26 is propagated while pumping alternating slugs of a thin-fluid spacer and temporary blocking agent with proppant therein into wellbore 10. Once the second hydraulic fracture screens out, a third hydraulic fracture originates from the tip of a CPF created radial vertical fracture which has the least closure stress resulting from the interaction of stresses from the first hydraulic fracture 20, second hydraulic fracture 26, and the original in-situ stresses. Hydraulic fracturing pressure and the pumping rate are maintained as above and another curved fracture is propagated. One curved fracture is shown to emanate from radial fracture 16. This hydraulic fracture has also been designated as 26 and intersects hydraulic fracture 24 which emanates from wellbore 8. These steps are repeated until a desired number of propped permeable sequential hydraulic fractures are created in formation 12 via wellbore 10. Once a desired number of hydraulic fractures have been created in this manner, wellbore 8 remains shut-in and hydrocarbonaceous fluids as well as other fluids from the formation are allowed to flow through the created interconnecting fluid system so as to remove any entrained material from the fractures. By allowing the fluids to flow through the created fracture system, the fractures are cleaned up. Subsequently, wellbore 10 is placed on production and a natural resource such as hydrocarbonaceous fluids are produced therefrom while wellbore 8 remains closed.

The enhanced drainage pattern which is created by communicating extended CPF fractures with the hydraulic fractures emanating from wellbore 8 is depicted in FIG. 2. This enhanced drainage pattern allows effective reservoir draining through the second well while the first well is shut-in without any induced pressures thereon. This method is particularly advantageous when used in an area where a second production well cannot be utilized due to state or federal regulatory controls which dictate the spacing of said well. By utilizing this method, the first well which is hydraulically fractured can be placed in a manner so as to communicate with the second well and still be in compliance with any state or federal regulations controlling the spacing of production wells. By utilizing the first well in this manner, the area designated for production can be more effectively drained of natural resources such as hydrocarbons while complying with the spacing of production wells.

As is known to those skilled in the art, multiple radial vertical fractures can be created at the wellbore and extended into the formation without crushing the formation adjacent to the wellbore when a propellant is utilized. A propellant means for creating more than two simultaneous multiple radial vertical fractures is placed in the well or wellbore substantially near the productive interval and ignited. As is known to those skilled in the art, the pressure loading rate is the primary parameter for the production of multiple fractures. The loading rate required to produce multiple fractures is an inverse function of wellbore or hole diameter. Hot gases are formed in the wellbore or borehole upon ignition of a propellant means thereby creating a pressure capable of fracturing rock formations. A method for creating said multiple radial vertical fractures by controlled pulse fracturing (CPF) is disclosed in U.S. Pat. No. 4,548,252 which issued to Stowe et al. on Oct. 22, 1985. This patent is hereby incorporated by reference herein.

In this present invention, a temporary blocking agent is utilized. One method for making a suitable temporary blocking agent is discussed in U.S. Pat. No. 4,333,461 which issued to Mueller on Jun. 8, 1982 which patent is hereby incorporated by reference. The stability and rigidity of the temporary blocking agent will depend upon the physical and chemical characteristics desired to be obtained. As is known to those skilled in the art, the temporary blocking agent should be of a stability and rigidity sufficient to withstand environmental conditions encountered in the formation. The temporary blocking agent which is utilized can comprise a solidifiable gel which breaks within about 0.5 to about 4 hours.

The process of this invention can be utilized in many applications, these applications are mentioned in U.S. Pat. No. 4,718,490, which issued to Uhri on Jan. 12, 1988. This patent is hereby incorporated by reference herein. Some of these applications include removal of desired resources from a formation containing geothermal energy, tar sands, coal, oil shale, iron ore, uranium ore, metallic salts and, as is preferred, hydrocarbonaceous fluids. The metallic salts comprise alkali metal salts and rare-earth metal salts. Exemplary alkali metal salts include sodium chloride and potash. Exemplary rare-earth metal salts comprise the lanthanide series, and the cerium group, especially lanthanum.

The steps of this invention can be practiced until a desired number of sequential hydraulic fractures have been created which fractures communicate with hydraulically induced fractures in a resource bearing formation which fractures thereby communicate with a wellbore. Once in the wellbore a desired resource can be produced to the surface.

Although the present invention has been described with preferred embodiments, it is to be understood that modifications and variations may be resorted to without departing from the spirit and scope of this invention as those skilled in the art will readily understand. Such modifications and variations are considered to be within the purview and scope of the appended claims.

What is claimed is:

1. A method for creating multiple sequential hydraulic fractures via hydraulic fracturing combined with controlled pulse fracturing where two wells are utilized comprising:

a) drilling and completing a first and second well in said reservoir so that said wells will be in fluid communication with each other after subsequent fracturing in each well;

b) creating more than two simultaneous multiple vertical fractures via a controlled pulse fracturing method in the second well;

c) thereafter hydraulically fracturing said reservoir via said first well thereby creating fractures in the reservoir and afterwards shutting-in said first well without any induced pressure;

d) applying thereafter hydraulic pressure to the reservoir via said second well in an amount sufficient to fracture said reservoir thereby forming a first hydraulic fracture perpendicular to the least principal in-situ stress where said first fracture originates from the tip of a controlled pulse fracture that is substantially perpendicular to the least principal stress;

e) maintaining the hydraulic pressure on the reservoir via said second well while pumping via the second well alternate slugs of a thin-fluid spacer and a temporary blocking agent having a proppant therein into said fracture until said fracture screens out whereupon a second hydraulic fracture is initiated at the tip of another controlled pulse fracture which than enhibits the least closure stress due to the alteration of the local in-situ stresses caused by said first hydraulic fracture;

f) maintaining the hydraulic pressure on said second well while pumping alternate slugs of said thin-fluid spacer and said blocking agent into said second hydraulic fracture thereby causing said second hydraulic fracture to propagate away from the first hydraulic fracture in step e) in a curved trajectory which eventually becomes substantially perpendicular to the original least principal in-situ stress due to the interaction of the original in-situ stresses and stress from the first hydraulic fracture in combination with stress from said second hydraulic fracture which additionally causes the curved fracture trajectory to intersect a fracture created in said first well;

g) maintaining said hydraulic pressure on the second well while pumping alternate slugs of said spacer and blocking agent into the fracture with the curved trajectory until this fracture screens out whereupon another hydraulic fracture initiates at the tip of another controlled pulse fracture which then exhibits the least closure stress due to alteration of the local in-situ stresses by all previously formed hydraulic fractures which causes another curved fracture trajectory to form and intersect the fracture created in said first well; and h) repeated steps f) and g) until a desired number of curved sequential hydraulic fractures are created as extensions to the multiple vertical radial fractures obtained in step b) so as to intersect the fracture created in said first well thereby creating a fracture system via said wells which allows a substantial improvement in removing a natural resource from said reservoir.

2. The method as recited in claim 1 where reservoir fluids are allowed to flow through fractures created via the first and second wells wells for a time sufficient to clean up the fractures.

3. The method as recited in claim 1 where hydrocarbonaceous fluids are produced from said second well while the first well is shut-in.

4. The method as recited in claim 1 where the first well can not be used as a producing well.

5. The method as recited in claim 1 wherein said thin-fluid spacer comprises water, diesel oils, alcohols, high gravity crude oils, petroleum distillates, aqueous acid solutions, and mixtures thereof.

6. The method as recited in claim 1 where said temporary blocking agent comprises a solidifiable gel which breaks within about 0.5 to 4 hours.

7. The method as recited in claim 1 where said resources comprise oil shale, coal, tar sand, copper ore, iron ore, uranium ore, and salts of alkali metals and rare-earth metals.

8. The method as recited in claim 1 where the proppant comprises sand in the range of about 8 about 60 U.S. mesh size.

* * * * *